United States Patent [19]

Sugioka

[11] 4,341,372

[45] Jul. 27, 1982

[54] AUTOMATICALLY MESHING SHEET WINCH

[75] Inventor: Masumi Sugioka, Shimada, Japan

[73] Assignee: Asahi Malleable Iron Co. Ltd., Tokyo, Japan

[21] Appl. No.: 175,105

[22] Filed: Aug. 4, 1980

[30] Foreign Application Priority Data

Sep. 18, 1979 [JP] Japan ..... 54-118717

[51] Int. Cl.[3] ..... B66D 1/30

[52] U.S. Cl. ..... 254/353; 254/371; 254/388

[58] Field of Search ..... 254/371, 380, 352–355, 254/280–281, 283–286, 306–309, 325–327, 334–338, 297, 344, 369, 388

[56] References Cited

U.S. PATENT DOCUMENTS

| | | | |
|---|---|---|---|
| 3,753,551 | 8/1973 | Tidwell | 254/334 |
| 3,985,340 | 10/1976 | Guangorena | 254/371 X |
| 4,151,980 | 5/1979 | Burton et al. | 254/371 |

FOREIGN PATENT DOCUMENTS

| | | | |
|---|---|---|---|
| 1550175 | 8/1979 | United Kingdom | 254/371 |
| 1558784 | 1/1980 | United Kingdom | 254/371 |

*Primary Examiner*—John M. Jillons

*Attorney, Agent, or Firm*—Ladas & Parry

[57] ABSTRACT

The disclosed automatically meshing sheet winch has a drum to be driven either directly or indirectly through a reduction gear by a main shaft, and a rope guide which includes an internal gear operatively related to another internal gear formed on a fixed base frame of the winch through a gear mounted on the main shaft, whereby the rope guide can be set at any desired angular position without modifying the position of the base frame.

18 Claims, 6 Drawing Figures

AUTOMATICALLY MESHING SHEET WINCH

BACKGROUND OF THE INVENTION

1. Field of the Invention

This invention relates to a sheet winch for marine use, and more particularly to an improvement of an automatically meshing sheet winch having a rope-meshing grooved pulley formed at one end of a winch drum thereof for preventing a rope wound on the winch drum from slipping and a rope guide for guiding the rope between the grooved pulley and the winch drum.

2. Description of the Prior Art

A typical automatically meshing sheet winch of the prior art comprises a fixed base having a fixed hollow cylinder, a winch drum rotatably carried by the hollow cylinder, a main shaft rotatably fitted in the hollow cylinder, a reduction gear disposed between the main shaft and the winch drum, and a rope guide fixed to the hollow cylinder. As the main shaft is turned by a suitable handle, the winch drum is rotated through the reduction gear, so that a rope can be wound on or paid out from the winch drum while being guided by the rope guide.

The automatically meshing sheet winch of the prior art has drawbacks in that the winch drum is driven only through the reduction gear, so that to provide a high-speed winding of the rope, the reduction gear should have a reduction ratio close to direct driving, resulting in a complicated structure of the reduction gear because reduction ratios for slow rope winding are indispensable even when the high-speed winding is provided. The complicated structure inevitably causes the sheet winch to become large and costly. Besides, the rope guide of the sheet winch of the prior art is fixed to the hollow cylinder integral with the base of the winch, and the angular position of the rope guide relative to the base of the winch is hard to modify.

SUMMARY OF THE INVENTION

Therefore, an object of the present invention is to obviate the aforementioned drawbacks and difficulties of the prior art, by providing an improved automatically meshing sheet winch including a direct driving means from a main shaft to a winch drum for allowing a high-speed winding of the rope on the winch drum, while simplifying a reduction gear of the sheet winch and reducing the overall size of the sheet winch for minimizing the cost thereof.

Another object of the present invention is to provide an automatically meshing sheet winch having a rope guide whose angular position can be set at will.

To fulfill the aforementioned objects, an automatically meshing sheet winch according to the present invention comprises a fixed base frame, a drum rotatably mounted on the base frame, a main shaft journalled by the base frame, a grooved pulley formed at one end of said drum for meshing a rope, an offset gear rotatably mounted on said main shaft, said offset gear having an axis of rotation thereof parallel to but offset from the axis of rotation of said main shaft so that the teeth of the gear partly extend outside of the circumferential surface of the main shaft, an internal gear formed on said base frame so as to mesh with said offset gear, and a rope guide rotatably carried by said base frame and having another internal gear integrally formed therewith, said other internal gear also meshing with said offset gear carried by the main shaft.

BRIEF DESCRIPTION OF THE DRAWING

For a better understanding of the invention, reference is made to the accompanying drawing, in which.

Like parts are designated by like numerals and symbols throughout different views of the drawing.

DESCRIPTION OF THE PREFERRED EMBODIMENTS

Figure 1:
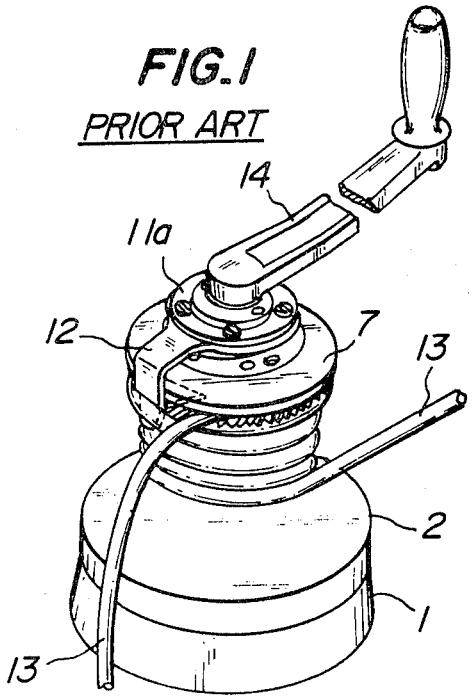
FIG. 1 PRIOR ART
FIG. 1 is a perspective view of an automatically meshing sheet winch as an example of the prior art.
Figure 2:
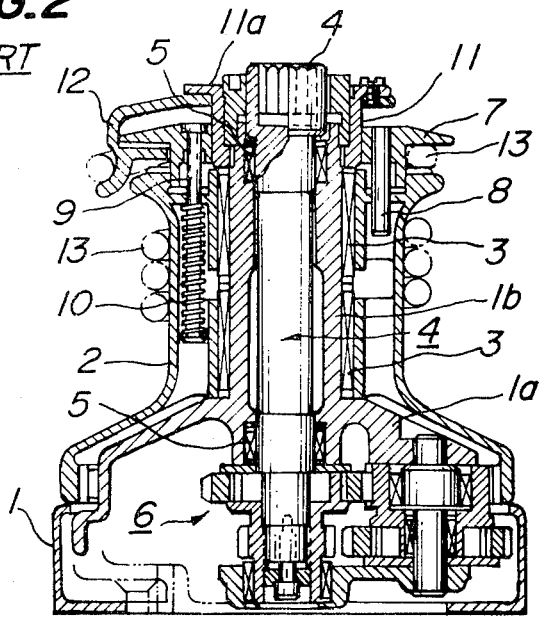
FIG. 2 PRIOR ART
FIG. 2 is a vertical sectional view of the sheet winch of FIG. 1.

Before entering the details of the present invention, an example of conventional automatically meshing sheet winch (Japanese Patent Laid-open Publication No. 126,650/76) will be briefly reviewed, by referring to FIGS. 1 and 2. A fixed base 1 of the sheet winch has a fixed frame 1*a* integrally formed therewith and a hollow cylinder 1*b* integrally formed with the fixed frame 1*a*. A winch drum (to be referred to as "drum" hereinafter) 2 is rotatably carried by the hollow cylinder 1*b* of the fixed frame with a roller bearing means 3 disposed therebetween, and a main shaft 4 is rotatably fitted in the hollow cylinder 1*b* with a roller bearing means 5 disposed therebetween. The drum 2 is operatively connected to the main shaft 4 through a reduction gear means 6. To form a V-grooved pulley with a variable groove width for meshing a rope 13, a clamp ring 7 is disposed above the top surface of the drum 2, and a pair of guide rods 8 and 9 slidably guide the clamp ring 7 in the direction of the longitudinal axial center line of the drum 2. The clamp ring 7 is biased toward the drum 2 by a coiled spring 10. A sleeve 11 with a flange 11*a* is securd to the fixed hollow cylinder 1*b*, and a rope guide 12 for guiding the rope 13 is fixed to the flange portion 11*a* of the sleeve 11. A handle 14 is operatively connected to the main shaft 4 at the top thereof.

In the sheet winch of the prior art, the rope guide 12 is fixed to the fixed hollow cylinder 1*b* through the sleeve 11, so that the modification of the operative angular position of the rope guide 12 is cumbersome. Besides, the construction of the prior art device does not allow easy direct connection of the main shaft 4 to the drum 2, and the drum 2 is always driven through the reduction gear means 6.

Figure 3:
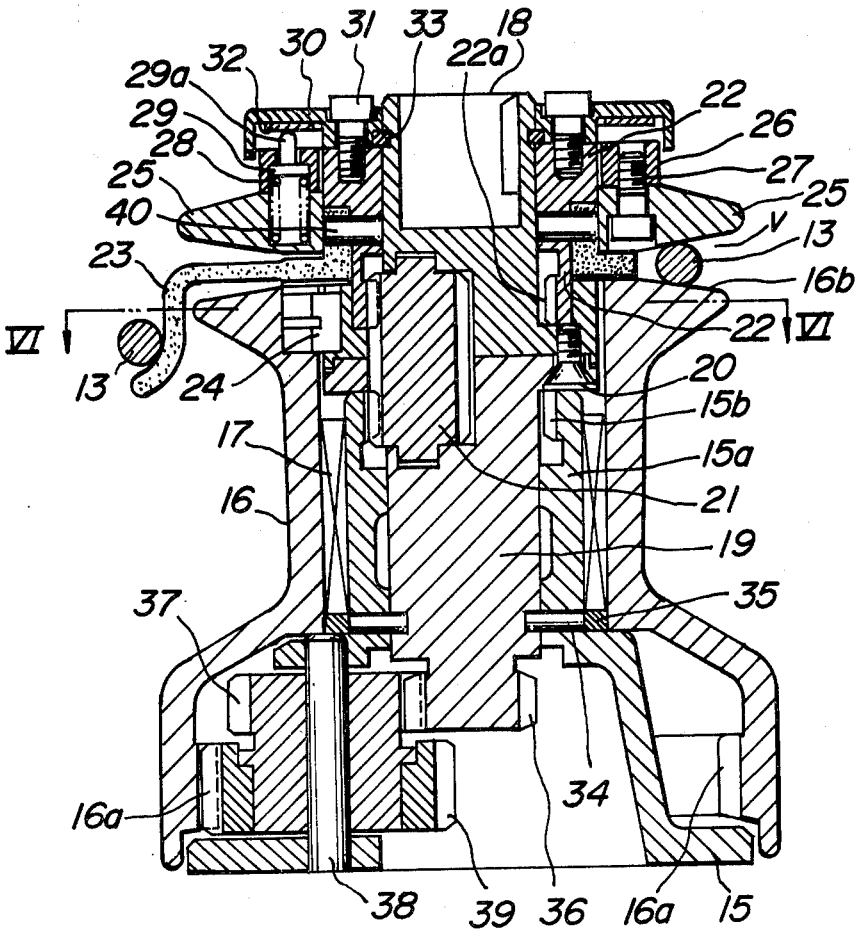
FIG. 3 is a vertical sectional view of an embodiment of the sheet winch according to the present invention.
Figure 6:
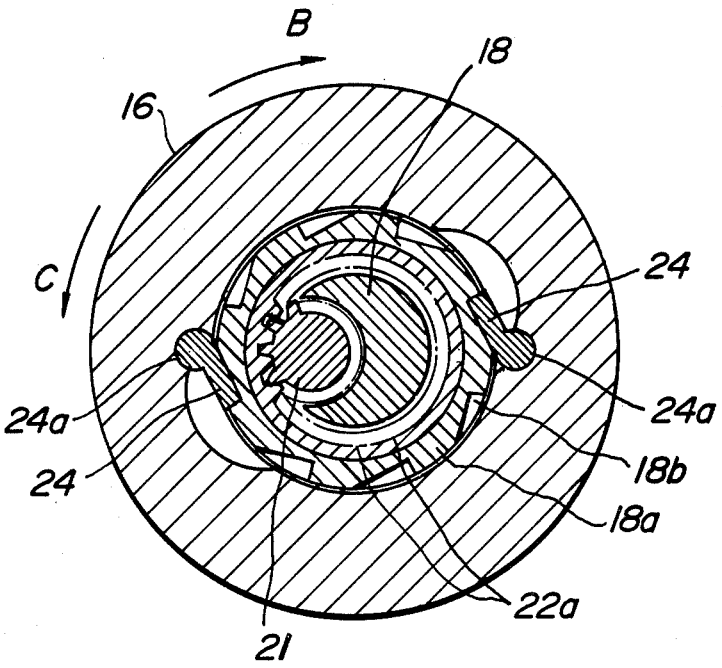
FIG. 6 is a horizontal sectional view taken along the line A—A of FIG. 3, FIG. 4, or FIG. 5.

An embodiment of the automatically meshing sheet winch according to the present invention will be now described by referring to FIGS. 3 and 6.

In the figures, a base frame 15 of the sheet winch has a hollow cylinder 15*a*, which hollow cylinder rotatably carries a drum 16 with a roller bearing means 17 disposed therebetween. The drum 16 has an internal gear 16*a* formed along the inner peripheral surface at the lower end thereof.

In the illustrated embodiment of the present invention, the main shaft of the sheet winch has an upper main shaft 18 and a separate lower main shaft 19, which shafts 18 and 19 are joined at flange portions thereof by screws 20. An offset gear 21 is disposed in the joint portion of the upper and lower main shafts 18 and 19, and the axis of rotation of the offset gear 21 is parallel to but offset from the axis of rotation of the main shafts so that the teeth of offset gear 21 partly extend to the outside of the circumferential surface of the main shafts 18 and 19. The lower portion of the teeth of the offset gear 21 mesh with an internal gear 15*b* formed at the upper end of the hollow cylinder 15*a*, while the upper portion of the teeth of the offset gear 21 mesh with another internal gear 22*a* formed along the inner peripheral surface at the lower end of a sleeve 22 rotatably carried by the upper main shaft 18. A rope guide 23 is integrally secured to the sleeve 22.

As can seen from FIG. 6, a ratchet wheel 18*a* is formed at the top flange portion of the upper main shaft 18, and pawls 24 coacting with the ratchet wheel 18*a* have base portions 24*a* thereof pivotally connected to the drum 16. The ratchet wheel 18*a* has a plurality of pawl recesses 18*b* provided on the surface of the ratchet wheel which coact with said pawls.

To form a rope-meshing V-grooved pully v with a variable groove width above the top surface 16*b* of the drum 16, a rope clamp ring 25 is slidably mounted on the sleeve 22. A spring-holding plate 26 is secured to the top surface of the rope clamp ring 25 by bolts 27, and a coiled spring 28 is disposed between the rope clamp ring 25 and the spring-holding plate 26. A spring pin 29 has a lower end seat portion engaging the top end of the spring 28 and a projecting portion 29*a* extending upward through the spring-holding plate 26. A cover 30 is fixed to the top surface of sleeve 22 by bolts 31, and a ring-shaped spacer 32 is secured to the lower surface of the cover 30. A stopper collar 33 registers the sleeve 22 relative to the upper main shaft 18, while a parallel pin 34 registers the lower main shaft 19 relative to the hollow cylinder 15*a*. The inner end portion of the parallel pin 34 slidably fits in an annular groove formed on the lower main shaft 19, and a pin-holding ring 35 prevents the parallel pin 34 from separating from the shaft 19.

The lower main shaft 19 has a driving gear 36 formed at the lower end thereof, and an intermediate gear 37 meshing with the driving gear 36 is rotatably secured to the base frame 15 by a shaft 38. Another gear 39 is coaxially connected to the intermediate gear 37 through a one-way clutch (not shown), which gear 39 meshes with the aforementioned internal gear 16*a* of the drum 16.

In the embodiment of FIG. 3, the rope guide 23 extends from the rope-meshing V-grooved pulley v, and the rope guide 23 is connected to the sleeve 22 by a pin 40.

Figure 4:
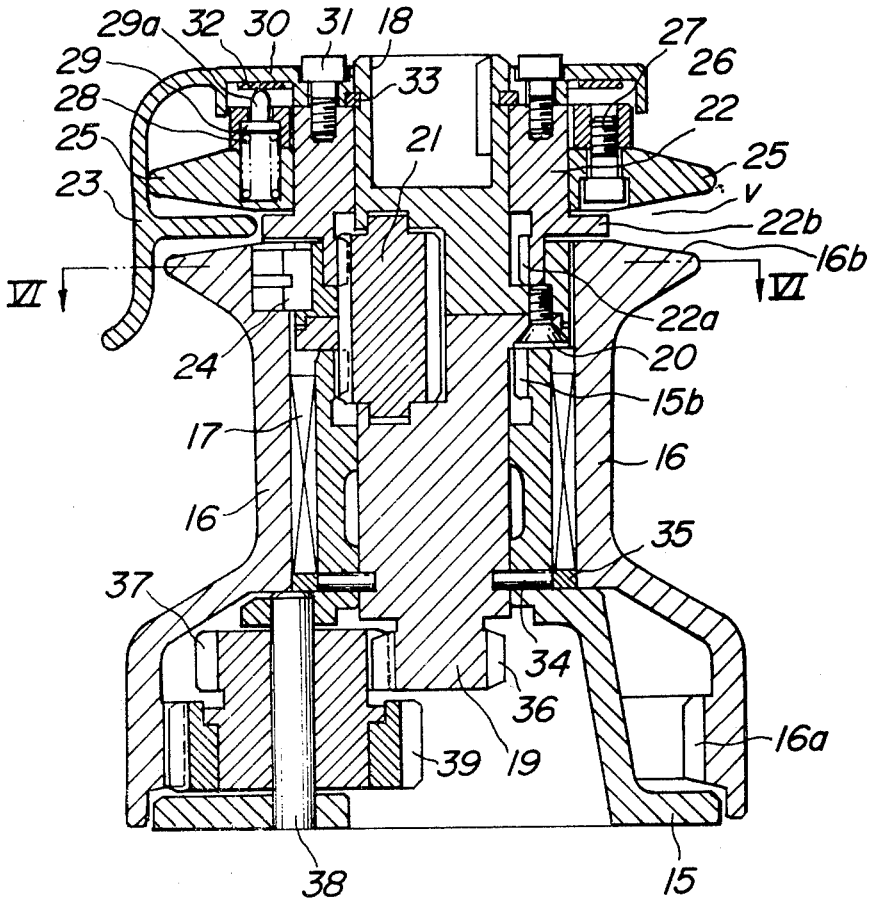
FIGS. 4 and 5 are vertical sectional views of different embodiments of the sheet winch of the invention.
Figure 5:
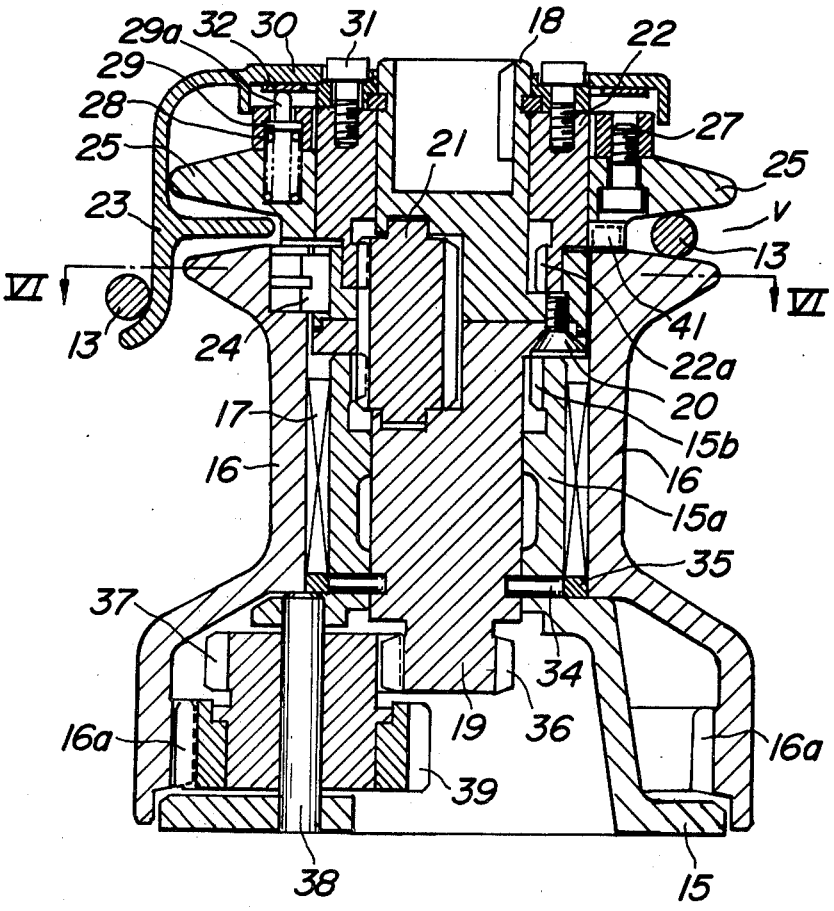

On the other hand, in the embodiments of FIGS. 4 and 5, the rope guide 23 is integrally formed with the aforementioned cover 30. More particularly, the embodiment of FIG. 4 uses a sleeve 22 having a flange 22*b* to be located at the bottom of the groove of the rope-meshing V-grooved pulley v. The embodiment of FIG. 5 uses a dog clutch like coupling 41 between the rope clamp ring 25 and the drum 16, which coupling 41 is located at the bottom of the groove of the rope-meshing V-grooved pulley v.

The operation of the sheet winch of the aforementioned construction according to the present invention will be now described. To directly drive the sheet winch, a handle (not shown) similar to the handle 14 of FIG. 1 is fitted to the top of the upper main shaft 18, and the upper main shaft 18 is turned in the direction of the arrow B of FIG. 6. Then, the ratchet wheel 18*a* integral with the upper main shaft 18 also turns in the direction of the arrow B, so that the pawls 24 engage with the pawl recesses 18*b* of the ratchet wheel 18*a* for directly driving the drum 16 together with the upper main shaft 18 in the direction of the arrow B. Thus, in the sheet winch of the present invention, the main shaft 18 and the drum 16 can be driven at a revolving speed change ratio or gear ratio of 1:1.

In this case, the offset gear 21 rotates together with the rotation of the main shafts 18 and 19, and the meshing of the lower portion of the gear 21 with the internal gear 15*b* of the fixed hollow cylinder 15*a* and the meshing of the upper portion of the offset gear 21 with the internal gear 22*a* of the sleeve 22 carrying the rope guide 23 act to keep the rope guide 23 stationary even if the drum 16 rotates and to hold the rope guide 23 at a preset angular position. Accordingly, the rope 13 wound on the drum 16 can be paid out from the drum; namely, the rope can be separated from the drum 16 through the rope guide 23 at the preset angular position for meshing with the rope-meshing V-grooved pulley v, and then the rope is paid out from the V-grooved pulley v toward a certain direction through the rope guide 23 after travelling along the V-shaped pulley v by one turn.

During the aforementioned direct driving, the gears 36 and 37 rotate in response to the rotation of the main shafts 18 and 19, but the one-way clutch (not shown) disposed between the gears 37 and 39 causes the gear 37 to slip relative to the gear 39. Thus, such rotation of the gears 36 and 37 do not interfere with the rotation of the drum 16.

To drive the drum 16 at a reduced gear ratio, the handle (not shown) is turned in the direction of the arrow C of FIG. 6. As the main shaft 18 rotates, the ratchet wheel 18*a* also turns in the direction of the arrow C, and the locking engagement between the pawl recess 18*b* of the ratchet wheel 18*a* and the pawls 24 is released under this condition. On the other hand, the gear 36 turns with the main shafts 18 and 19 in the direction of the arrow C, for turning the intermediate gear 37 in a direction opposite to that during the direct driving. As a result, the intermediate gear 37 turns the gear 39 through the one-way clutch (not shown), so as to drive the drum 16 through the meshing of the gear 39 with the internal gear 16*a* of the drum 16. In this case, the drum 16 rotates in the direction of the arrow B at a lower gear ratio than that during the direct driving.

The rope guide 23 functions in the same way during this operation with a reduced gear ratio as that during the direct driving.

The groove width of the rope-meshing V-grooved pulley v is easily adjustable by the coiled spring 28, so that variations of the size of the rope 13 and the winding diameter of the rope 13 on the drum can be absorbed by the adjustment of the groove width of the V-grooved pulley v.

In the foregoing embodiments of the invention, a speed change gear with only one gear ratio is used, but it is also possible to use speed change gears with two or more gear ratios in the sheet winch of the present invention, as apparent to those skilled in the art.

The following effects can be achieved by the sheet winch of the aforementioned structure according to the present invention.

(1) A direct driving mechanism is incorporated in an automatically meshing sheet winch, so that winding and paying out of the rope can be effected faster than that of the prior art, and the handling of a boat is made easier.

(2) A combination of the direct driving and driving at reduced gear ratios is provided, for facilitating the ease of rope work. More particularly, the rope can be wound on the sheet winch at a high speed, and as the load increases lower gear ratios can be selected in succession. Thus, any of the different gear ratios can be selected so as to meet specific requirements under different operative conditions.

(3) The rope guide 23 can be set at any desired angular position. More particularly, the angular position of the rope guide 23 for operation can be freely set by selecting a proper meshing between the offset gear 21 and the internal gear 22*a*, regardless of the fixed direction of the based frame 15. Therefore, the direction of the base frame 15 is not restricted by the rope guide 23 when the base frame 15 is fixed to a boat.

(4) In a multi-speed winch, the availability of direct driving makes it possible to minimize the speed reduction gear for simplifying the structure thereof and to reduce the overall size of the winch, whereby the automatically meshing sheet winch can be manufactured at a low cost.

Although the invention has been described with a certain degree of particularity, it is understood that the present disclosure has been made only by way of example and that numerous changes in details of construction and the combination and arrangement of parts may be resorted to without departing from the scope of the invention as hereinafter claimed.

What is claimed is:

1. An automatically meshing sheet winch, comprising a fixed base frame, a main shaft journalled by the base frame, a drum rotatably mounted on the base frame, a grooved pulley formed at one end of said drum for meshing a rope, an offset gear rotatably mounted on said main shaft, said offset gear having an axis of rotation thereof parallel to but offset from the axis of rotation of said main shaft so that teeth of the offset gear partly extend to outside of the circumferential surface of the main shaft, an internal gear formed on said base frame so as to mesh said offset gear, and a rope guide rotatably mounted on said base frame and having another internal gear integrally formed therewith, said other internal gear also meshing said gear carried by the main shaft.

2. An automatically meshing sheet winch as set forth in claim 1, wherein said main shaft has an upper main shaft and a lower main shaft, and said gear extends from said upper main shaft to said lower main shaft.

3. An automatically meshing sheet winch as set forth in claim 1, wherein said rope guide extends from said grooved pulley.

4. An automatically meshing sheet winch as set forth in claim 1, wherein said sheet winch has a top cover integrally formed with said rope guide.

5. An automatically meshing sheet winch as set forth in claim 1, wherein a rope clamp is mounted above the top of said drum so as to form said grooved pulley by said rope clamp and said top of said drum.

6. An automatically meshing sheet winch as set forth in claim 5, wherein said rope guide is integrally secured to a sleeve, and a spring is disposed between said rope clamp and said sleeve, whereby the groove width of said rope-meshing grooved pulley is automatically adjusted by said spring with variation of thickness of the rope being handled by said sheet drum.

7. An automatically meshing sheet winch as set forth in claim 4, wherein a rope clamp ring is coupled to the upper ring portion of said drum through a dog clutch like coupling so as to form a rope-meshing V-grooved pulley.

8. An automatically meshing sheet winch as set forth in claim 1, wherein said reduction gear means includes a one-way clutch, which clutch transmits power in only one direction of rotation and allows slipping in the opposite direction of rotation.

9. An automatically meshing sheet winch, comprising a fixed base frame, a main shaft journalled by the base frame, a drum rotatably mounted on the base frame, a reduction gear means disposed between said main shaft and said drum, a selecting means for selectively connecting said drum to one of said main shaft and said reduction gear means, a grooved pulley formed at one end of said drum for meshing a rope, an offset gear rotatably mounted on said main shaft, said offset gear having an axis of rotation thereof parallel to but offset from the axis of rotation of said main shaft so that teeth of the gear partly extend to outside of circumferential surface of the main shaft, an internal gear formed on said base frame so as to mesh said offset gear, and a rope guide rotatably mounted on said base frame and having another internal gear integrally formed therewith, said other internal gear also meshing said gear carried by the main shaft.

10. An automatically meshing sheet winch, comprising a fixed base frame, a main shaft journalled by the base frame, a drum rotatably mounted on the base frame, a grooved pulley formed at one end of said drum for meshing a rope, an offset gear rotatably mounted on said main shaft, said offset gear having an axis of rotation thereof parallel to but offset from the axis of rotation of said main shaft so that the teeth of the offset gear partly extend outside the circumferential surface of the main shaft, a sleeve journalled with said main shaft, an internal gear formed on said base frame as to mesh with said offset gear, and another internal gear integrally formed on said sleeve so as to mesh with said offset gear, a rope guide fixed on said sleeve and extending outward beyond the top of said grooved pulley; wherein said both internal gears have the same pitches so as to mesh with said offset gear.

11. An automatically meshing sheet winch as set forth in claim 10, wherein one intermediate gear meshes a driving gear integrally formed on a main shaft, and an internal gear of said drum meshes another intermediate gear coaxially mounted relative to said one intermediate gear and said another intermediate gear through a one-way clutch.

12. An automatically meshing sheet winch as set forth in claim 10, wherein said main shaft comprises an upper main shaft and a lower main shaft, and said offset gear extends from said upper main shaft to said lower main shaft.

13. An automatically meshing sheet winch as set forth in claim 10, wherein said sheet rope guide extends outwardly from said grooved pulley so as to guide the rope to take off.

14. An automatically meshing sheet winch as set forth in claim 10, wherein said sheet winch has a top cover secured to said sleeve.

15. An automatically meshing sheet winch as set forth in claim 10, wherein a rope clamp is mounted above the top of said drum so as to form said grooved pulley by said rope clamp and said top of said sheet drum.

16. An automatically meshing sheet winch as set forth in claim 15, wherein a spring is disposed between said rope clamp and said sleeve, whereby the groove width of said rope-meshing grooved pulley is automatically adjusted by said spring with variation of thickness of the rope being handled by said sheet drum.

17. An automatically meshing sheet winch as set forth in claim 10, wherein a rope clamp ring is coupled to the upper ring portion of said drum through a dog clutch like coupling so as to form a rope-meshing V-grooved pulley, and a spring is disposed between said rope clamp and said sleeve, whereby the groove width of said rope-meshing grooved pulley is automatically adjusted by said spring with variation of thickness of the rope being handled by said sheet drum.

18. An automatically meshing sheet winch as set forth in claim 10, wherein a ratchet wheel is formed at a top flange portion of the upper main shaft and a pawl is provided coacting with said ratchet wheel, said ratchet wheel having a base portion thereof pivotally connected to the drum, said rope clamp is coupled to said drum through a dog clutch, and said reduction gear means includes a oneway clutch, said clutch transmitting power in only one direction of rotation and allows slipping in the opposite direction of rotation.

* * * * *